United States Patent [19]

Maitland

[11] 4,267,772

[45] May 19, 1981

[54] INK SUPPLY CARTRIDGE

[75] Inventor: Roy Maitland, Laguna Niguel, Calif.

[73] Assignee: Count Numbering Machine, Inc., San Diego, Calif.

[21] Appl. No.: 89,404

[22] Filed: Oct. 30, 1979

Related U.S. Application Data

[63] Continuation of Ser. No. 875,379, Feb. 6, 1978, abandoned, which is a continuation-in-part of Ser. No. 714,004, Aug. 13, 1976, abandoned.

[51] Int. Cl.[3] ..... B41F 1/42; B41F 1/48

[52] U.S. Cl. ..... 101/103; 101/333; 101/364

[58] Field of Search ..... 101/103, 104, 108, 287, 101/288, 292, 364, 333, 335, 334, 324, 132.5, 310, 318; 401/205, 263, 219, 237; 222/486; 118/264, 267, 266

[56] References Cited

U.S. PATENT DOCUMENTS

| | | | |
|---|---|---|---|
| 517,036 | 3/1894 | Dolphin | 101/367 |
| 1,263,094 | 4/1918 | Millea | 101/103 X |
| 1,353,994 | 9/1920 | Folger et al. | 101/103 |
| 1,525,659 | 2/1925 | Rumpf | 101/103 |
| 2,065,694 | 12/1936 | Hatcher | 101/103 |
| 2,756,674 | 9/1956 | Rieger et al. | 101/333 X |
| 2,983,219 | 5/1961 | Weissman | 101/103 |
| 3,182,867 | 5/1965 | Barosko et al. | 222/486 |
| 3,241,482 | 3/1966 | Keck | 101/103 |
| 3,326,180 | 6/1967 | Lofgren | 101/333 X |
| 3,356,442 | 12/1967 | Leland | 401/219 X |
| 3,363,548 | 1/1968 | Aijima | 101/333 X |

*Primary Examiner*—J. Reed fisher

*Attorney, Agent, or Firm*—Emrich, Root, Lee, Brown & Hill

[57] ABSTRACT

An ink supply cartridge, for use with an insignia applying device having a chassis, a movable insignia element mounted within the chassis and a support member mounted to the chassis and the movable insignia element and pivotally movable into and out of the path of travel of the movable insignia element, includes a housing containing an ink supply portion and having an ink applying member and a retainer member for attaching the ink supply cartridge to the support member. The ink supply portion is adapted to receive an ink reservoir member which is adjustable to control the flow of ink to the ink applying member and the insignia element as desired. The attached ink supply cartridge is positioned to be engageable with the insignia element to ink the insignia element when the element is within the housing in the at rest position. When the mechanical insignia element is triggered and moves to engage the substrate material, the support member and attached ink supply cartridge are pivotally moved out of the way of the insignia element device to permit the engagement of the insignia element upon the substrate material.

3 Claims, 16 Drawing Figures

INK SUPPLY CARTRIDGE

BACKGROUND OF THE INVENTION

The present application is a continuation application of Ser. No. 875,379, now abandoned, filed Feb. 6, 1978 by the present inventor and assigned to the Assignee of the present invention. application Ser. No. 875,379 was in turn a continuation-in-part Application of Ser. No. 714,004, now abandoned, filed Aug. 13, 1976 in the name of the present inventor and assigned to the Assignee of the present invention.

In insignia applying devices for numbering various types of substrate materials, it is often desirable to provide an ink supply for use in conjunction with the insignia applying device. In the past the insignia element portion of the applying devices has been pre-inked prior to their usage. However, such pre-inked insignia elements possess only a limited number of impressions, on the order of two to five hundred, until it is necessary to either re-ink or re-fill the device with inking material. Because such pre-inked supplies are positioned either within the device or attached thereto, they, of necessity, must be extremely small in size. Also, such insignia applying devices involve complicated mechanical and electrical structures the increased time and labor involved in removing and refilling such insignia applying devices have prevented their widespread application. This is even more true when the insignia applying devices have been used in conjunction with printing presses and the like. In such applications, the limited number of impressions available from such devices have resulted in lengthy down time of such presses, a result which is commercially unacceptable.

SUMMARY OF THE INVENTION

It is an object of the present invention to provide an ink supply cartridge for use in conjunction with an insignia applying device which greatly increases the number of impressions obtainable from such insignia devices.

It is another object of the present invention to provide an improved ink supply cartridge utilizing relatively few parts which is of simple construction and is reliable in operation.

It is a further object of the present invention to provide an ink supply cartridge which is manually attachable to existing insignia applying devices to accomplish the rapid insertion and attachment of the ink supply cartridge to the insignia applying device.

It is still a further object of the present invention to provide an adjustable ink supply cartridge which is attachable to insignia applying devices to control the flow of ink from the supply cartridge to the insignia applying element.

It is still a further object of the present invention to provide an ink supply cartridge capable of supplying fast drying ink to the insignia applying device.

In a preferred embodiment of the present invention, the insignia applying device is generally comprised of a chassis having a movable insignia element mounted within the chassis. The insignia element is movable from at at rest position, within the chassis, to an outward position wherein the element engages or strikes a substrate material to number or mark the same. The insignia applying device chassis generally includes a U-shaped bracket having a support member mounted to the U-shaped bracket and mounted to the movable insignia element such that when the insignia element is triggered and moved outwardly from the chassis to engage the substrate material, the support member is pivotally moved out of the path of travel of the movable insignia element. The support member includes an elongated opening centered therein to assist in attaching the ink supply cartridge, as will hereinafter be described.

The ink supply cartridge of the present invention for use in conjunction with such insignia applying devices includes a housing containing an ink supply portion and an ink applying portion. The housing includes a partition wall separating the ink supply portion and the ink applying portion. The ink applying portion includes an applicator member mounted therein which engages and inks the insignia element. The partition wall within the ink supply cartridge includes either a plurality of openings therein or a slotted narrow elongated opening therein to permit the ink to flow from the ink supply portion to the ink applying portion. The ink supply portion of the housing is adapted to receive and hold an ink reservoir member which is adjustable to control the flow of ink to the ink applying member and the insignia applying element as desired. The control of the ink flow is achieved by rotating the reservoir member to align the opening in the reservoir member with the opening in the partition wall of the ink supply cartridge. The ink supply housing includes also a projection element extending outwardly therefrom which is engageable with the support member to firmly hold the ink supply cartridge containing the applicator member therein in engaging position against the insignia element when the insignia element is within the chassis in its inward at rest position. When the insignia element is triggered, either manually or electronically, the support member holding the ink supply cartridge thereon is pivotally moved out of the way of the insignia element device as the insignia element moved outwardly from the chassis to engage or strike a substrate material to number or mark the same. After the insignia element engages the substrate material it is returned inwardly within the chassis and the support member is pivotally returned to its original position wherein the applicator member within the ink applying portion of the ink supply cartridge is in engaging position with the insignia element to ink the same for the next operation. If it is desired to stop the flow of ink when the insignia applying device is not in operation, the reservoir member may be rotated to seal the reservoir member from the openings in the partition wall.

In a further embodiment the ink supply cartridge of the present invention, the cartridge includes an L-shaped housing separated into an ink reservoir portion and an ink applying portion. An applicator member is mounted within the ink applying portion and a clip member extends around the ink supply cartridge and includes a detent member extendingly along the bottom thereof which is selectively engageable with the slotted opening in the support member to firmly hold the ink supply cartridge and the applying applicator member in engaging position against the insignia elements when the insignia element is in its inward at rest position with the chassis. When the insignia element is manually or electronically triggered the support member pivotally mounted to the chassis, is again pivotally moved out of the way of the insignia element device to permit the printing, numbering or marking of the insignia element upon the substrate material.

The unique combination of the ink supply cartridge firmly mounted to an insignia applying device provides on the order of ten to forty thousand impressions from the insignia element, without the necessity of refilling or resupplying the insignia applying device with inking material. The number of impressions obtainable from the insignia element depends upon the type of ink being used, the size of the insignia element being printed and the absorbancy of the substrate material being printed upon. Additionally, the ink supply cartridge is readily removable and detachable from the insignia applying device to permit the user thereof to change the color of the ink as desired without the necessity of stopping the operation on which the insignia applying device is used. Also, the reservoir member may be rotated to misalign the opening in the member with the opening or opening in the partition wall to stop the flow of ink to the ink applying member. Moreover, the ink supply cartridge of the present invention has particular application with operations involving numbering, printing, dating, coding, pressure sensitive labels affixing, and addressing.

DETAILED DESCRIPTION

Figure 7:
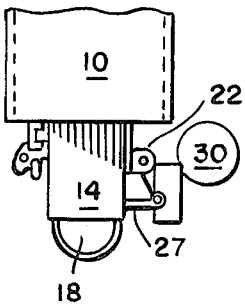
FIG. 7 is a partial elevational end view of the insignia applying device in the operative position incorporating an ink supply cartridge in accordance with the present invention.
Figure 8:
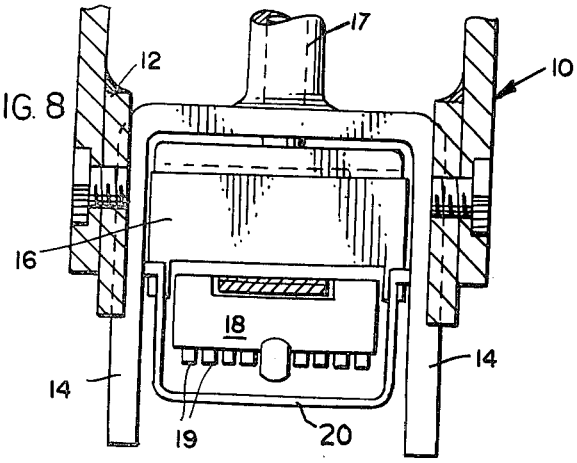
FIG. 8 is a cross-sectional view of an insignia applying device to which the ink supply cartridge of the present invention is incorporated.

Referring now to the drawings wherein like numbers have been used throughout the various views to designate similar parts, there is illustrated in FIG. 8 an insignia applying device 10 in which the ink supply cartridge 30 according to the present invention is employed. The insignia applying device 10 includes a chassis 12 having a U-shaped member 14 mounted integrally within the chassis 12 which defines and forms a carriage assembly 16. The U-shaped member 14 projects downwardly from the chassis 12 and slidably supports a vertically disposed rod 17 (partially shown) which supports an insignia applying pad or element 18 mounted to the carriage assembly 16. The insignia applying element 18 is preferably in the form of a number of individually adjustable bands or markings 19 thereon that are disposed side by side with each band having a number of insignia or indicia (not shown) thereon. The bands 19 may be adjusted relative to one another such that the insignia or indicia thereon may be presented in a desired sequence of letters or numbers or other type of indicia. The manner in which the interchangeable marking or number element or head 18, attached to carriage 16 and supported from rod 17, is inserted into and held by the insignia applying device 10 is disclosed and claimed in co-pending application Ser. No. 714,010, entitled "Electro-Mechanical Marking Device", Ser. No. 925,558, which was a continuation-in-part application of application Ser. No. 714,010, now issued as U.S. Pat. No. 4,181,560, filed by the same inventor and assigned to the Assignee of the present invention. The rod 17 is engageable by a drive element (not shown) which is energized by an electrically operated solenoid (not shown) within the device 10 which imparts movement to the vertically disposed rod 17 to move the head 18 from the at rest position (FIG. 5) to an actuated position (FIG. 7).

The insignia applying device 10 may be mounted on any type of printing press or other device (not shown) that includes an automatic stack feed for a substrate material. As the substrate material is fed from the stack to the printing press or the like, the solenoid senses the movement of the substrate and energizes the rod 17 to move the carriage 16 thereby causing the insignia applying element 18 to be vertically moved downwardly to engage or mark the substrate material, as is well known in the art. The stack feed elements of the printing press or similar type device are conventional in design and no detailed description of such structure is necessary.

Figure 5:
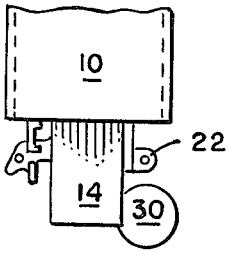
FIG. 5 is a partial elevational end view of an insignia applying device in the at rest position incorporating an ink supply cartridge in accordance with the present invention.

The U-shaped member 14 includes projection portions 22 extending outwardly therefrom which are adapted to fixedly mount the support member 20 mounted to the projections 22 (FIG. 7). Additionally, the support member 20 is also mounted by a pair of lever arms 27 (FIG. 7) to the bottom 28 of the insignia applying element 18. The support member 20 includes also a slotted or elongated opening 25, therein (best shown in FIGS. 1, 9 and 12) which is adapted to receive and hold the ink supply cartridge 30, as will hereinafter be described. When the insignia applying element 18 is energized and moves vertically downwardly to engage and number or mark the substrate material, the downward movement of the insignia applying element 18 causes the support member 20 to pivot about the axis of the mounting, on projections 22 of the U-shaped member 14 such that the support member 20 is pivoted 90° out of the path of travel of the insignia applying element 18, as shown in FIGS. 5 and 7.

In FIGS. 1-4 and 15 an ink supply cartridge 30 in accordance with the present invention includes a housing 32 having a tubular ink supply portion means or reservoir portion 33 and an ink applying portion or cavity portion 36. Below the ink supply cavity portion 36 and extending outwardly from the ink supply reservoir 33 is a projection or retaining means or member 38 (FIG. 1) which defines an opening 39 between the bottom 40 of the ink applying cavity 36 and the projection clip member 38. Preferably, positioned on the bottom of the ink applying portion 36 is a projection 41 which cooperates with the end 42 of the retaining clip member 38 to firmly engage the support member 20 and the slotted opening 25 therein to hold the ink supply cartridge 30 firmly to the support member 20.

Figure 15:
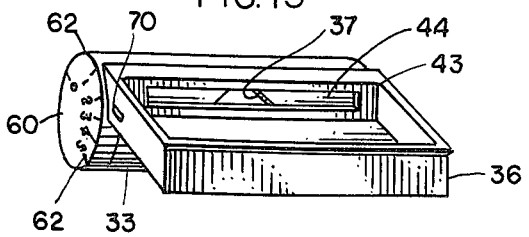
FIG. 15 is an enlarged perspective view showing the position of the ink reservoir member within the ink supply portion, as shown in FIG. 2.
Figure 16:
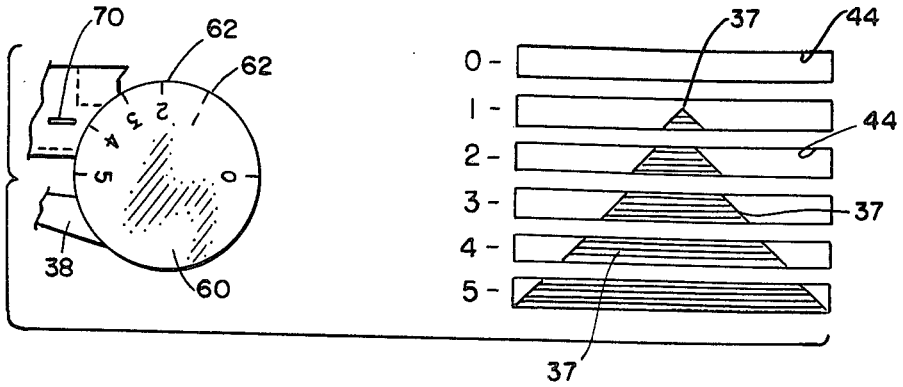
FIG. 16 is an enlarged schematic view showing the controlled flow of ink from the ink supply portion to the ink applying position in accordance with the present invention.

The ink supply cartridge 30 includes a partition means or wall 43 located between the ink applying cavity 36 and the ink supply portion 33. Located within the partition wall 43 and extending partially along the length thereof is a slotted opening 44 (FIG. 15) which permits the ink within the ink supply portion 33 to pass into the ink applying cavity 36, although it is within the scope of this disclosure to include a plurality of holes or openings extending along the length of partition wall 43 to permit ink to pass from the ink supply portion 33 to the applying portion 36. The ink supply portion 33 includes a cavity opening 34 therein which is adapted to receive and hold an ink reservoir cartridge or member 35 (FIG. 2) therein. The ink reservoir member 35 includes a V-shaped opening 37 therein and an end head member 60 having indicia 62 thereon. Additionally, within the cavity opening 34 of the ink supply portion 33, a ring seat 63 is positioned which is adapted to receive the sealing ring 65 located on the reservoir member 35. When the reservoir member 35 is inserted into cavity opening 34, the sealing ring 65 rests in ring seat 63 to firmly retain and hold the member 35 therein while permitting rotating of the reservoir member. When the indicia 62 are properly aligned with marking 70 on housing 32 (FIG. 16), a predetermined flow of ink from the ink supply portion 33 to the ink applying portion 36 results. For example, as shown in FIGS. 15 and 16, when indicia is aligned with marking 70, no ink will flow and when head 60 is rotated until indicia five is aligned with marking 70, a substantially full supply of ink will flow from the supply portion 33 to the applying portion 36. Positioned within the ink applying cavity 36 is a felt or other type of applicator means or member 45 which retains the ink and is sufficiently absorbent and resilient such that when the ink supply cartridge 30 is firmly engaged and held by support member 20, the insignia element is properly inked for each cycle of operation. As desired, a cover member 47 having a recess 71 and having a handle 48 thereon may be secured over the ink applying cavity 36 and lip portion 73 to prevent evaporation of the ink supply from the ink supply cartridge 30 when the cartridge has been removed from the insignia applying device and is not in use. The handle portion 48 is optional but provides for easy removal of the cover from the ink supply cartridge 30. To fill the cartridge with ink, the felt member 45 is removed and ink is poured into the applying portion 36. The ink passes through opening 44 into reservoir member 35 within the ink supply portion 33.

Figure 1:
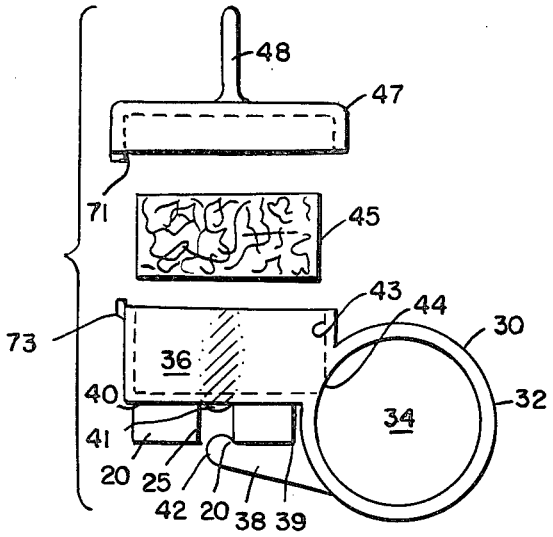
FIG. 1 is an enlarged view of an ink supply cartridge in accordance with the present invention.
Figure 2:
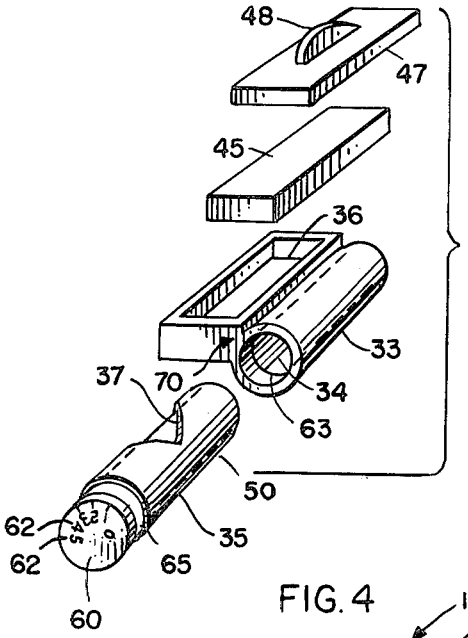
FIG. 2 is an enlarged perspective view of the ink supply cartridge, as shown in FIG. 1, and the ink reservoir member in accordance with the present invention.
Figure 3:
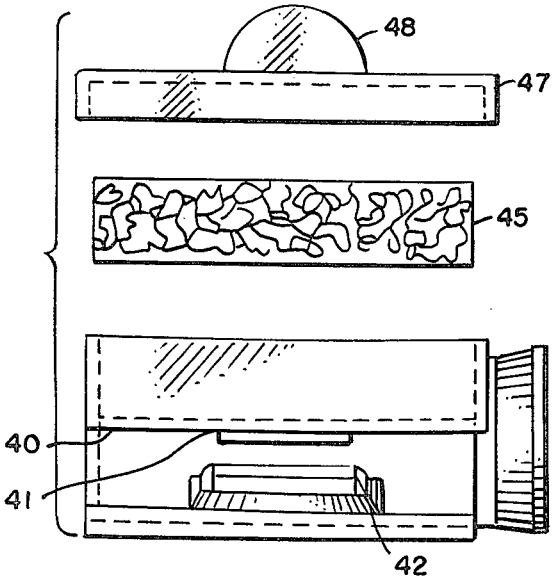
FIG. 3 is an enlarged side elevation view of the ink supply cartridge as shown in FIG. 1.
Figure 4:
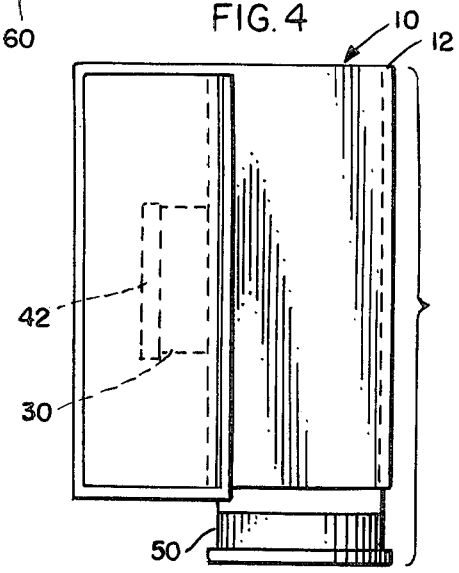
FIG. 4 is an enlarged bottom plan view of the ink supply cartridge as shown with FIG. 1.

As shown in FIG. 1, the ink supply cartridge 30 is firmly held to the insignia applying device by the insertion of the cartridge 30 onto support member 20. Support member 20 is adapted to be received by the opening 39 between the retaining clip projection 38 and the bottom 40 of the ink supply portion 36 such that the retaining clip projection 38 cooperates with the projection 41 on the bottom 40 of the ink supplying portion 36 and slotted opening 25 in member 20 to firmly hold the ink supply cartridge. When the ink supply cartridge 30 has been inserted onto the insignia applying device 10, the resilient applicator or member 45 is engageable with the insignia applying element 18 to ink the same before each cycle of operation. If it is desired to remove the ink supply cartridge 30 or change the color of the ink thereof, it is only necessary to grasp the cartridge and manually remove the same from the insignia applying device.

Figure 6:
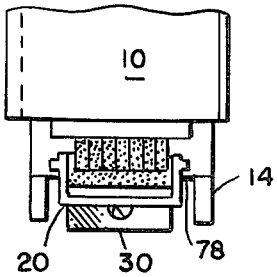
FIG. 6 is a side view of an ink supply-is a partial elevational side view of the insignia applying device incorporating an ink supply cartridge as shown in FIG. 5.
Figure 9:
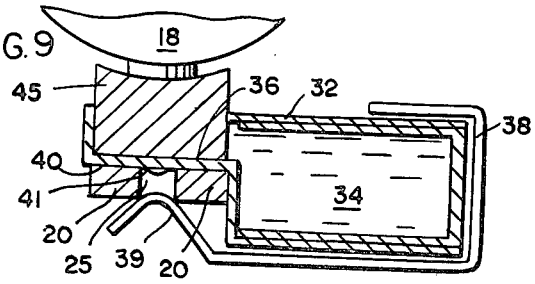
FIG. 9 is a cross-sectional view of an insignia applying device incorporating a further embodiment of an ink supply cartridge in accordance with the present invention.
Figure 10:
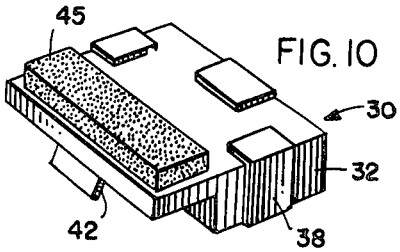
FIG. 10 is a perspective view of the ink supply cartridge as shown in FIG. 9.

In FIGS. 9 and 10 a further embodiment of the ink supply cartridge 30 is shown. Again, the cartridge housing 32 includes an ink supply portion 34 and an ink applying portion 36 having a resilient applicator material 45 extending upwardly therefrom. The bottom 40 of the ink applying portion 36 includes a projection 41 extending downwardly therefrom which is adapted to rest in slotted opening 25 in support member 20 when the cartridge 30 is held by the support member 20. The retaining clip member 38 extends around the housing 32 and includes an end detent member 42 which extends outwardly under the bottom 40 of the ink applying portion 36 to cooperate with projection 41 thereon to hold the cartridge 30 firmly onto the support member 20 and the opening 25 therein. The operation of the insignia applying device 10 with such a supply cartridge 30 is the same as set forth above to the cartridge embodiment described in FIGS. 5-7.

Figure 12:
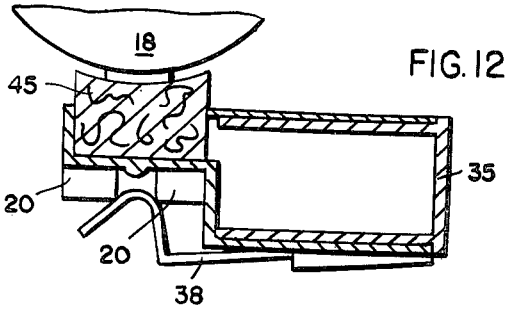
FIG. 12 is a cross-sectional view of the insignia applying device incorporating a further embodiment of an ink supply cartridge in accordance with the present invention.
Figure 14:
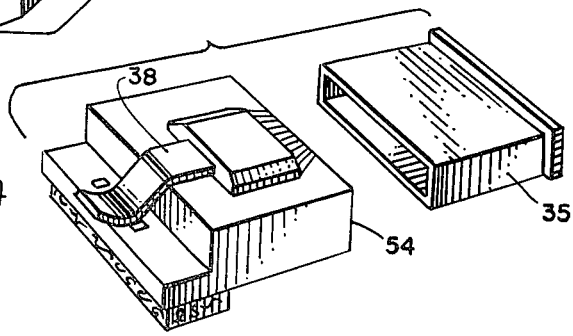
FIG. 14 is an enlarged bottom perspective view of the ink supply cartridge as shown in FIG. 12.

FIGS. 12 and 14 describe a further embodiment of the ink supply cartridge 30 wherein the housing 32 includes an open side end 54 which defines an ink supply portion 36 which is adapted to receive an ink supply cartridge 35, a disposable ink supply cartridge 35. As shown in FIG. 14, the disposable ink supply cartridge 35 is inserted into end 52 to supply ink to the cartridge 30, as desired. In this embodiment of the cartridge 30, the retaining clip member 38 has been molded integrally to the bottom of the ink supply cartridge and operates in the same manner and fashion, as set forth above, to retain and hold the ink supply cartridge onto the support member 20 of the insignia applying device 10.

Figure 11:
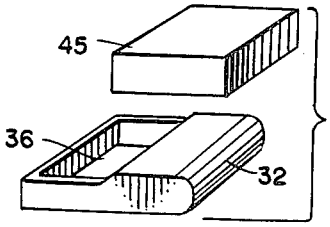
FIG. 11 is an enlarged perspective view of a further embodiment of an ink supply cartridge in accordance with the present invention.
Figure 13:
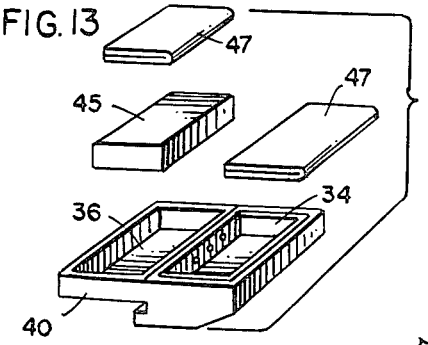
FIG. 13 is an enlarged perspective view of a further embodiment of an ink supply cartridge in accordance with the present invention.

In FIG. 11, a further embodiment of the supply cartridge 30 of the present invention includes a housing 32 defining an ink supply cavity 36 therein which is adapted to receive and hold a resilient applicator member 45 therein. Molded integrally to the bottom of the cartridge thereof is a retaining clip projection 38 which cooperates with the support member 20 and the slotted opening 24 therein to hold the cartridge to the insignia applying device 10, as set forth above. And in FIG. 13, a further embodiment of the ink supply cartridge 30 is disclosed wherein covers 47 are adapted to seal the ink supply reservoir 34 and the ink applying portion 36 when the ink supply cartridge 30 is not in use. Here, the partition wall 43 includes a plurality of openings 44 therein which permit the ink to pass from the ink supply portion 34 to the ink applying portion 36 containing the applicator member 45. Additionally, the retainer clip member 38 is molded integrally to the cartridge 30 and cooperates in a similar manner with a projection (not shown) on the bottom 40 of the ink applying portion 36 to hold the cartridge firmly to the support member.

Additionally, the ink has been used in a broad sense to mean any type of chemical substance which may be printed or stamped upon a substrate material.

What has been described is a unique ink supply cartridge which is adapted to be received and held to an insignia applying device to provide on the order of approximately forty or fifty thousand impressions or operations by the insignia applying device without the need for re-inking of the insignia applying device. Moreover, the rapid interchangeability of the unique ink supply cartridge of the present invention permits the use of multiple colors for providing color changes, as desired. Moreover, the provision of a cover upon the cartridge, when the same has been removed from the insignia applying device, permits the user of the device to retain the ink supply cartridge for further use and permits the user to use extremely fast drying ink in conjunction with the insignia applying device. Also, the unique structure of the disposable ink cartridge provides for the predetermined control of the flow of ink to the interchangeable marking head because of the centrifugal force of pivotal action of the ink cartridge supported on support member 20 when the same is pivoted out of the path of the movement of the insignia applying device to its actuated position.

The ink supply cartridge is useful with an insignia applying device 10 having a pivotally mounted support member 20 in a movable insignia element 18. The cartridge includes a housing adapted to receive and hold the supply of ink and an applicator means extending outwardly from the housing and adapted to communicate with the insignia device to permit the flow of ink to the insignia device. The cartridge includes retaining means engageable with the housing and cooperating with the pivotly mounted support member to firmly hold the applicator means in engagement with the insignia element 18 to permit the inking of the insignia element after each cycle of operation of the insignia applying device 10. Preferably, the retaining means is molded integrally to and extending outwardly from the cartridge housing to cooperate with the support member 20 to firmly hold the cartridge housing to the insignia applying device.

Additionally, the ink supply cartridge of the present invention is adapted to engage the interchangeable marking heads, such as numberers, printers, daters and coders, marginal word imprinters and bar-coders, as described and claimed in co-pending application Ser. No. 714,010, now abandoned, entitled "Electro-Mechanical Marking Device, " and Ser. No. 925,588 which was a continuation-in-part application of application Ser. No. 714,010, now issued as U.S. Pat. No. 4,181,560, filed by the same inventor and assigned to the Assignee of the present invention, as well as individual marking devices containing only an individual insignia applying head.

I claim:

1. An ink supply cartridge for use with an insignia applying device having a pivotally mounted support member thereon and a movable insignia element therein, the ink supply cartridge including in combination:

a cartridge housing having an ink applying portion containing applicator means extending outwardly from said cartridge housing and adapted to communicate with the movable insignia element to permit the flow of ink to the insignia element, said cartridge housing further including a tubular ink supplying portion adapted to receive a tubular ink supply member, said cartridge housing further having partition means positioned between said ink applying portion and said tubular ink supplying portion with said partition means having at least one opening therein, and wherein said tubular ink supply member is rotatable in said ink supplying portion and includes a V-shaped slotted opening in the tubular surface thereof which communicates with at least one opening in said partition means for predeterminely controlling the flow of ink from said ink supplying portion to said ink applying portion and said applicator means, and wherein said cartridge housing further includes a projection clip member integral thereto and extending outwardly from said ink supplying portion adjacent said ink applying portion to define an opening therebetween, said clip member being engageable with the pivotally mounted support member when the same is positioned between said clip member and said applying portion to firmly hold said applicator means in said cartridge housing and said cartridge housing in engagement with the insignia applying device to permit the inking of the insignia element after each cycle of operation of the insignia applying device.

2. The ink supply cartridge in accordance with claim 1 further including cover means engageable with said ink applying portion of said housing to firmly retain said applicator means within said housing and to seal said ink applying portion when the ink supply cartridge is removed from the support member of the insignia applying device.

3. The ink supply cartridge in accordance with claim 1 wherein said rotatable ink supply member includes an end head member having indicia thereon to indicate the amount of flow of ink from said ink supply member to said applicator means.

* * * * *